US012188391B1

(12) United States Patent
Lemaster et al.

(10) Patent No.: US 12,188,391 B1
(45) Date of Patent: Jan. 7, 2025

(54) VEHICLE OXYGEN SENSOR LIGHT OFF CONTROL

(71) Applicant: FCA US LLC, Auburn Hills, MI (US)

(72) Inventors: David E Lemaster, Ortonville, MI (US); Matthew L Bresler, Clarkston, MI (US); Steven L Talley, Detroit, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 18/414,611

(22) Filed: Jan. 17, 2024

(51) Int. Cl.
*F01N 11/00* (2006.01)
*F01N 3/20* (2006.01)

(52) U.S. Cl.
CPC ..... *F01N 11/007* (2013.01); *F01N 3/2006* (2013.01); *F01N 2900/1402* (2013.01)

(58) Field of Classification Search
CPC ..... F02D 41/064; F02D 41/1455; F02D 41/1476; F01N 11/007; F01N 3/2006; F01N 2900/1402
See application file for complete search history.

(56) References Cited

U.S. PATENT DOCUMENTS

| | | | | |
|---|---|---|---|---|
| 4,543,176 | A * | 9/1985 | Harada | G01N 27/4065 204/406 |
| 10,019,854 | B1 * | 7/2018 | McQuillen | F02D 41/1482 |
| 10,487,764 | B1 * | 11/2019 | Behr | F02D 41/1455 |
| 2009/0133464 | A1 * | 5/2009 | Sell | F02D 41/064 73/1.03 |
| 2010/0154525 | A1 * | 6/2010 | White | F02D 41/1455 73/114.73 |
| 2018/0128149 | A1 * | 5/2018 | McQuillen | F01N 11/007 |
| 2019/0078491 | A1 * | 3/2019 | Fosaaen | G01N 27/16 |
| 2020/0256268 | A1 * | 8/2020 | Surnilla | F02D 35/0046 |

* cited by examiner

*Primary Examiner* — Matthew T Largi
(74) *Attorney, Agent, or Firm* — Jeremy J. Klobucar

(57) ABSTRACT

A control system for a vehicle having an internal combustion engine with an exhaust system includes one or more oxygen (O2) sensors disposed proximate to a catalytic converter, a first bias circuit configured to provide a first bias voltage to the one or more O2 sensors, and a second bias circuit configured to provide a second bias voltage to the one or more O2 sensors. A controller is programmed to: upon detecting a cold start condition, connect the one or more O2 sensors to the first bias circuit to receive the first bias voltage to rapidly detect a usable signal indicating light off of the one or more O2 sensors, to thereby facilitate initiation of a closed loop feedback control to reduce exhaust emissions; and subsequently connect the one or more O2 sensors to the second bias circuit to receive the second bias voltage to operate in the closed loop feedback control.

20 Claims, 3 Drawing Sheets

VEHICLE OXYGEN SENSOR LIGHT OFF CONTROL

FIELD

The present application relates generally to vehicle engine exhaust treatment systems and, more particularly, to oxygen sensor heating control for vehicle exhaust systems.

BACKGROUND

Catalysts are typically implemented in vehicle exhaust systems for treating exhaust gas produced by an internal combustion engine to mitigate or eliminate emissions. A majority of the cumulative tailpipe emissions measured on standard test cycles are attributed to a cold start, due to the inability of a cold three-way catalytic converter (TWC) to convert carbon monoxide (CO) and unburnt hydrocarbons (HC) to produce carbon dioxide (CO2) and water (H2O), as well as reduce nitrogen oxides (NOx) to nitrogen (N2). Typical exhaust systems include one or more oxygen sensors to detect an exhaust gas air-fuel ratio, which may be utilized for engine control to reduce emissions. However, such sensors are often inoperable or inaccurate before they reach a predetermined light-off temperature required for closed loop control, for example, during cold starts. Thus, while such conventional systems do work for their intended purpose, it is desirable to provide continuous improvement in the relevant art.

SUMMARY

In accordance with one example aspect of the invention, a control system for a vehicle having an internal combustion engine with an exhaust system is provided. In one example implementation, the control system includes one or more oxygen (O2) sensors disposed proximate to a catalytic converter in the exhaust system, the one or more O2 sensors each being configured to measure an O2 level of exhaust gas produced by the engine. A first bias circuit is configured to provide a first bias voltage to the one or more O2 sensors, and a second bias circuit is configured to provide a second bias voltage to the one or more O2 sensors, the second bias voltage being higher than the first bias voltage. A controller is programmed to: detect a cold start condition; upon detecting the cold start condition, connect the one or more O2 sensors to the first bias circuit to receive the first bias voltage to rapidly detect a usable signal indicating light off of the one or more O2 sensors, to thereby facilitate initiation of a closed loop feedback control to reduce exhaust emissions; and subsequently connect the one or more O2 sensors to the second bias circuit to receive the second bias voltage to operate in the closed loop feedback control.

In addition to the foregoing, the described control system may include one or more of the following features: wherein the second bias voltage is a pumping current bias voltage; wherein the pumping current is between approximately 12 mA and approximately 20 mA; wherein the second bias voltage is approximately 5 volts; wherein the first bias voltage is approximately 0.45 volts; and wherein the controller is programmed to connect the first bias circuit to the one or more O2 sensors for a predetermined period of time before connecting the one or more O2 sensors to the second bias circuit.

In addition to the foregoing, the described control system may include one or more of the following features: wherein the predetermined period of time is approximately 20 seconds; wherein the one or more O2 sensors include a galvanic cell battery and a pair of porous platinum electrodes separated by layers of zirconia; wherein the one or more O2 sensors generate a voltage between approximately 0.1 volts and approximately 0.9 volts to provide a signal to the controller for the closed loop feedback control; and wherein the controller includes a switch configured to selectively connect to either the first bias circuit or the second bias circuit.

In accordance with another example aspect of the invention, a method of reducing exhaust emissions during a cold start of a vehicle having an internal combustion engine with an exhaust system is provided. In one example implementation, the method includes providing a controller in electrical communication with one or more oxygen (O2) sensors disposed proximate to a catalytic converter in the exhaust system, the one or more O2 sensors each being configured to measure an O2 level of exhaust gas produced by the engine; providing a first bias circuit configured to provide a first bias voltage to the one or more O2 sensors; providing a second bias circuit configured to provide a second bias voltage to the one or more O2 sensors, the second bias voltage being higher than the first bias voltage; detecting, by the controller, a cold start condition; connecting, by the controller, the one or more O2 sensors to the first bias circuit to receive the first bias voltage to rapidly detect a usable signal indicating light off of the one or more O2 sensors, to thereby facilitate initiation of a closed loop feedback control to reduce exhaust emissions; and subsequently connecting, by the controller, the one or more O2 sensors to the second bias circuit to receive the second bias voltage for normal operation in the closed loop feedback control.

In addition to the foregoing, the described method may include one or more of the following features: wherein the second bias voltage is a pumping current bias voltage; wherein the pumping current is between approximately 12 mA and approximately 20 mA; wherein the second bias voltage is approximately 5 volts; wherein the first bias voltage is approximately 0.45 volts; wherein the first bias circuit is connected to the one or more O2 sensors for a predetermined period of time before connecting the one or more O2 sensors to the second bias circuit; and wherein the predetermined period of time is approximately 20 seconds.

In addition to the foregoing, the described method may include one or more of the following features: wherein the one or more O2 sensors include a galvanic cell battery and a pair of porous platinum electrodes separated by layers of zirconia; wherein the one or more O2 sensors generate a voltage between approximately 0.1 volts and approximately 0.9 volts to provide a signal to the controller for the closed loop feedback control; and wherein the controller includes a switch configured to selectively connect to either the first bias circuit or the second bias circuit.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

Figure 1:
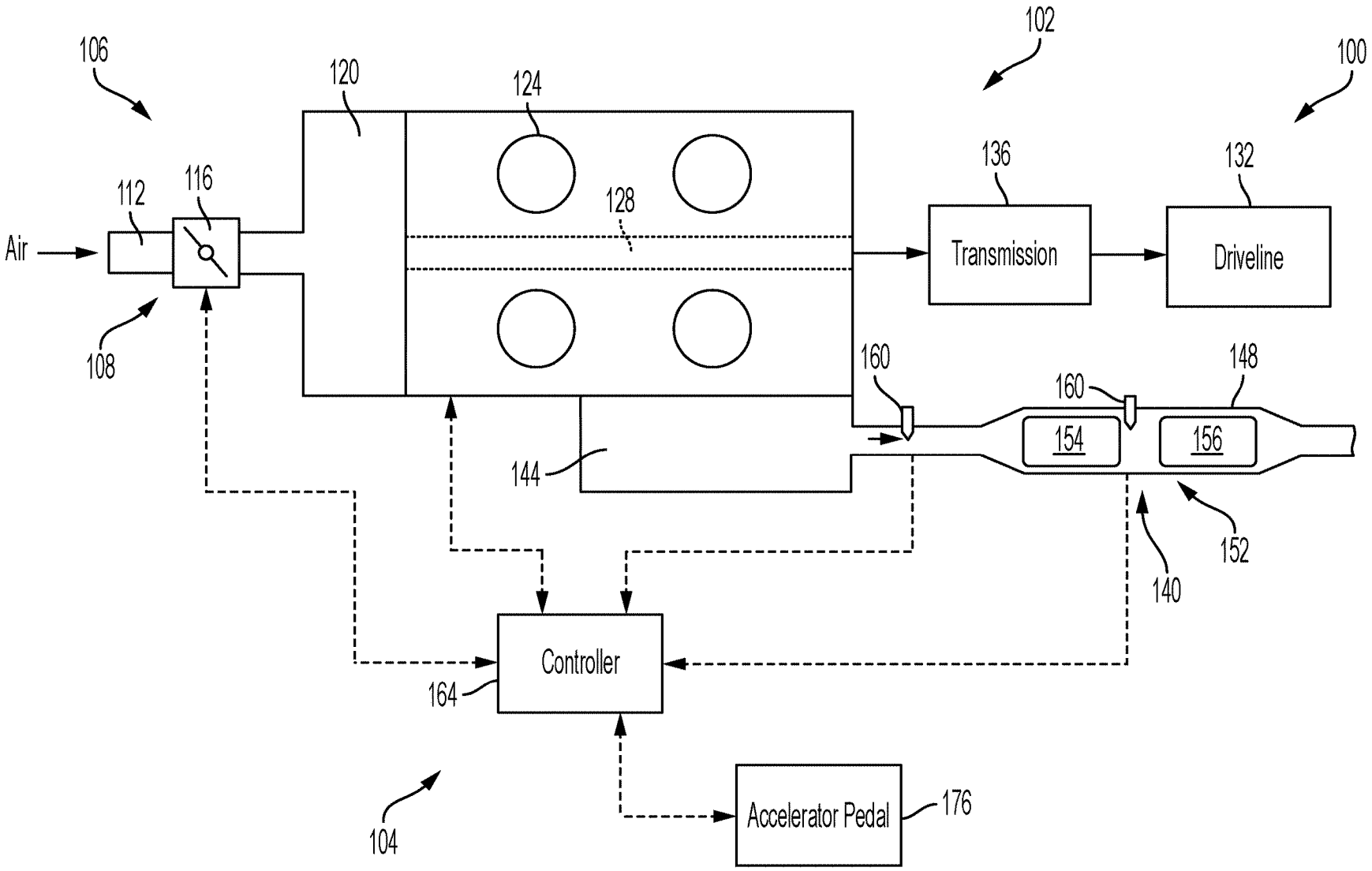
FIG. 1 is a schematic diagram of an example vehicle having an internal combustion engine and an exhaust system in accordance with the principles of the present application.

As previously mentioned, some vehicle exhaust systems include a three-way catalytic converter (TWC) to convert exhaust gas constituents such as carbon monoxide (CO), carbon dioxide (CO2), oxygen (O2), hydrocarbons (HC), and nitrogen oxides (NOx) to reduce emissions. Every second the engine is running and the catalyst is not at or above light-off temperature, exhaust gas constituents such as CO, CO2, O2, HC, and NOx are not being converted efficiently. The short time preceding the catalyst light-off is responsible for a very large portion of the CO, HC, and NOx breakthrough for on and off cycle starts and long idles. Additionally, during cold start, fueling is in open loop operation as it takes some time for the oxygen (O2) sensor to heat up before it is ready for closed loop operation. During this time, large fueling inaccuracies can occur, increasing tailpipe emissions of the engine while fueling is in open loop control with no feedback.

Accordingly, the systems and methods described herein provide O2 sensor heating control, which is configured to enable closed loop fueling operation for improved emissions during engine starts. In the engine controller, there is a first oxygen sensor bias circuit at 450 mV and a second oxygen sensor bias circuit with a pull-up resistor at 5 volts. On an emission or cold start, the controller begins a sensor light-off operation with the 450 mV bias circuit. Once the zirconia impedance is lower (e.g., about 10-20 seconds of engine run time), the controller switches to the 5 volt pull up resistor pumping circuit. This first 450 mV bias voltage will allow the engine controller to identify the sensor light off much faster (e.g., ~2-6 seconds), thereby allowing the engine system to achieve closed loop control quicker than conventional systems and reduce overall emissions. This in effect will lower precious metal requirements in the catalytic converter.

The oxygen (O2) sensor is configured to provide optimal engine power, emissions, and economy over the entire engine operating range. The O2 sensor it utilized by the engine management system to monitor the optimum emissions of the exhaust system, for example, to achieve an idea air-fuel ratio of 14.7:1 or lambda 1. The O2 sensor is typically located in the exhaust manifold to sense all oxygen in that particular manifold bank. Alternatively, O2 sensors are located prior to and after the catalytic converter to determine the efficiency of the oxygen storage in the catalytic converter. The O2 sensor is configured to generate a voltage based on the amount of oxygen in the exhaust gas, thereby providing real-time feedback on the fuel mixture composition to the engine controller.

In one example, the oxygen sensor includes a galvanic cell battery and two porous platinum electrodes separated by layers of zirconia. The O2 sensor is configured to generate a voltage as low as 100 mV (0.1 volts) to a maximum of approximately 900 mV (0.9) volts, based on the level of oxygen in the exhaust stream. The O2 sensor may be configured to compare the exhaust oxygen content to the reference oxygen content, extracted from the exhaust gas. When the exhaust has little oxygen (e.g., a fuel rich condition), the O2 sensor is configured to produce a voltage of approximately 900 mV. When the exhaust has a lot of oxygen (e.g., a fuel lean condition), the sensor is configured to produce a voltage of approximately 100 mV. In the example system, the average bias voltage for the O2 sensor is 450 mV or approximately 450 mV.

The O2 sensor may require a pumping current such as, for example, approximately 10-20 mA. The pumping current is applied across the O2 sensor sensing element in order to keep the reference air charged on the bottom of the electrode. In this way, the pumping current is used to take oxygen from the exhaust system and push it into the O2 sensor for its reference oxygen instead of attempting to read open-air oxygen as its reference. Accordingly, a pumping current bias circuit in the engine controller includes a pull up resistor that allows the 10-20 mA current for the pumping current, and the voltage is about 5 volts when the impedance of the zirconia cell is cold. Once the O2 sensor is heated, the impedance becomes lower and the O2 sensor signal will start to cycle between rich and lean.

Once this happens, the engine controller can begin closed loop fueling with a feedback loop between the engine controller and the O2 sensor to make fueling adjustments. Typically, because of the 5 V reference, using the traditional method to declare sensor light off (e.g., monitoring the switch voltage traveling below 300 mV for lean then above 600 mV for rich signal), it may take a long time for the engine system to enter the closed loop control. This is because when you pull down from 5 V, the sensor can provide an output, but it is masked because of the 5 V.

However, in the example embodiment, using the 450 mV bias without the 5V pullup pumping circuit during light off, allows the engine system to detect and declare O2 sensor light off more quickly. In this way, 450 mV bias circuit is only looking at the sensitivity of the sensor and is biased at 450 mV between the swing from lean to rich. For example, when the engine controller monitors the sensor signal and sees the signal cross 600 mV down to 300 mV and back up to 600 mV, the engine controller can declare a valid light-off signal indicating the O2 sensor is operational for closed loop control. Accordingly, the 450 mV bias circuit enables the engine controller to see the O2 sensor signal faster. Therefore, the control system can initialize the closed loop control more quickly than using the pumping circuit alone (e.g., less than six seconds).

As such, this additional 450 mV bias circuit can be selectively utilized during emission starts (light-off phase) to reduce light off time. After a predetermined period of engine run time (e.g., 20 seconds), once the zirconia impedance is lower, the bias circuit can be switched back to the pumping current bias voltage (e.g., 5 V) and operate normally with accuracy. Accordingly, having two different bias circuits that can be switched will allow the controller to see a usable O2 signal faster than conventional systems, thereby improving emissions.

Referring now to FIG. 1, a schematic diagram of an example vehicle 100 is illustrated having a powertrain 102 and an engine control system 104 according to example implementations of the disclosure. In the illustrated example, the powertrain 102 generally includes an internal combustion engine 106 that draws air through an induction system 108 comprising an induction passage 112, a throttle valve 116, and an intake manifold 120. The air in the intake manifold 120 is dispersed to cylinders 124 and combined with fuel to form a fuel/air mixture that is combusted (e.g., by spark plugs) within cylinders 124 to drive pistons (not shown) that rotatably turn a crankshaft 128 generating drive torque. While four cylinders are shown, it will be appreciated that the engine 104 could include any suitable number of cylinders (six, eight, etc.).

The drive torque is transferred to a driveline 132 via a transmission 136. It will be appreciated that the vehicle 100 could have a hybrid driveline where the drive torque generated by the engine 104 is transferred to an electric motor or generator instead of or in addition to the transmission 136. Exhaust gas resulting from combustion is expelled from the cylinders 124 into an exhaust system 140. The exhaust system 140 comprises an exhaust manifold 144, an exhaust passage 148, and a catalytic converter 152 disposed along the exhaust passage 148 and configured to mitigate or eliminate CO, HC, and NOx in the exhaust gas.

In the example embodiment, the catalytic converter is a TWC 152 that includes an upstream brick or catalyst 154 and a downstream brick or catalyst 156 for catalytic reactions. As previously discussed, the TWC 152 oxidizes the CO and HC (i.e., combines them with O2) to produce carbon dioxide (CO2) and water (H2O), and the TWC 152 reduces the NOx to nitrogen (N2) and O2. The exhaust system 140 further comprises an upstream exhaust gas O2 sensor 160 and a downstream exhaust gas O2 sensor 160. In the example embodiment, one O2 sensor 160 is disposed upstream of the first catalyst 154, and the other O2 sensor 160 is disposed "mid-brick" between the first and second catalysts 154, 156. Alternatively, the second O2 sensor 160 may be disposed downstream of second catalyst 156. It will be appreciated that the techniques of the present disclosure could be achieved using only one of these sensors 160 (e.g., to save costs). However, utilizing both of the sensors 160 may increase the accuracy and/or robustness of the techniques.

Figure 2:
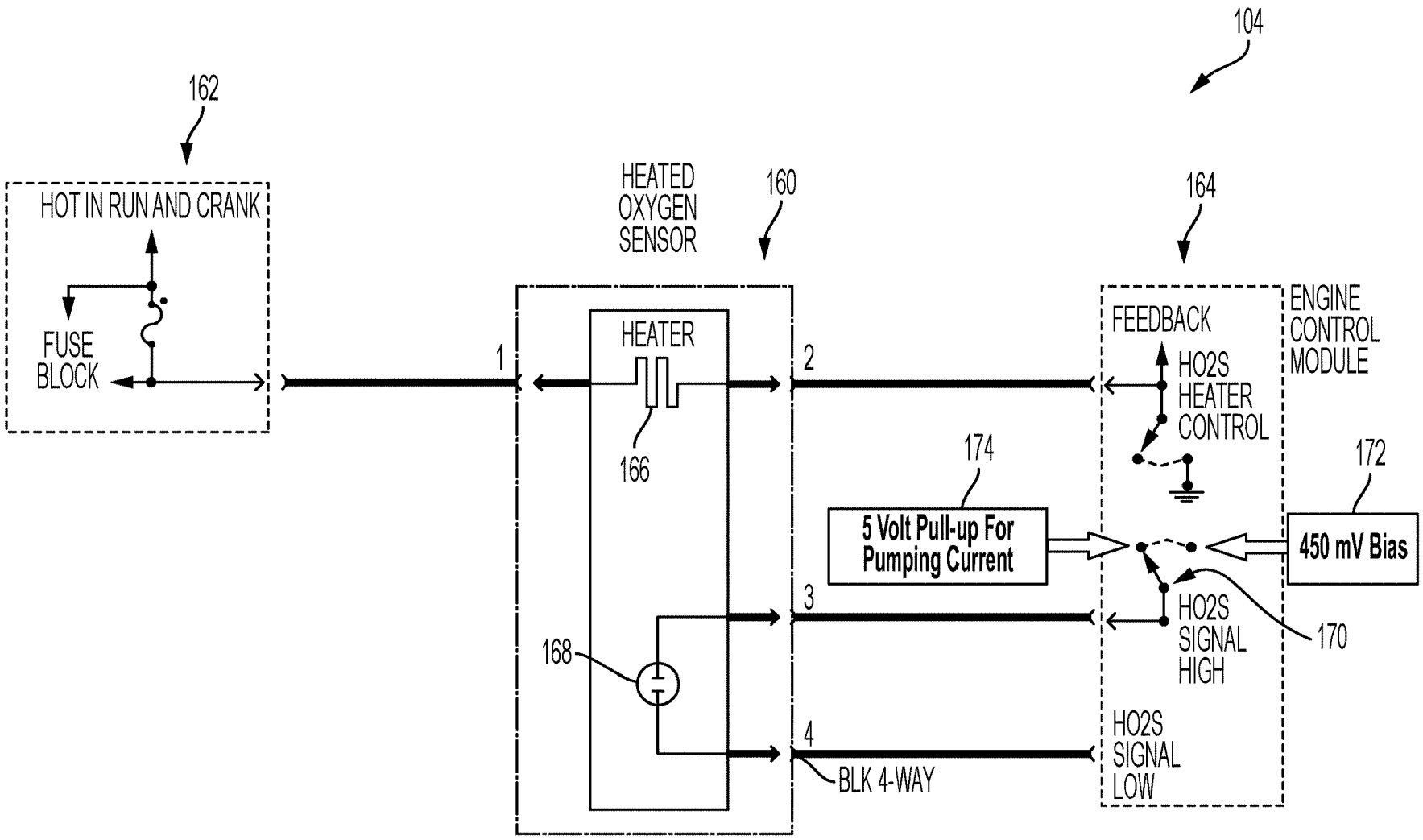
FIG. 2 is a schematic diagram of an example control system that may be utilized with the vehicle of FIG. 1, in accordance with the principles of the present application.

With additional reference to FIG. 2, a portion of the engine control system 104 is described in more detail. In the example embodiment, the engine control system 104 includes O2 sensor 160 connected to a power supply 162 and an engine control module or controller 164 (e.g., ECU). In the example embodiment, the O2 sensor 160 includes a heating element 166 (e.g., a resistor) configured to heat the O2 sensor 160 during cold start or cold ambient conditions. The O2 sensor 160 is heated to a predetermined target light-off temperature (e.g., ~700° C.) in order to enable/provide proper sensor feedback to controller 164 for closed loop fueling control of engine 106. For example, the O2 sensor may be calibrated to be accurate within a tight temperature tolerance since temperature of the O2 sensor affects the concentration and diffusion rate of the oxygen within the sensing element. Accordingly, if the O2 sensor 160 has not reached the predetermined target temperature, it may be inaccurate or unusable.

In one example implementation, the O2 sensor includes a battery 168 (e.g., galvanic cell) with two porous platinum electrodes separated by layers of zirconia (not shown). The engine control module 164 includes a switch 170 to selectively connect the O2 sensor 160 to either a first bias circuit 172 or a second bias circuit 174. In the example embodiment, the first bias circuit 172 is configured to provide the O2 sensor 160 with a first voltage (e.g., 450 mV), and the second bias circuit 174 is a pull up resistor pumping circuit configured to provide the O2 sensor 160 with a higher, second voltage (e.g., 5 V pumping current).

In one example, the O2 sensors 160 are linear-type O2 sensors, which switch their output in response to rich and lean fuel/air (FA) ratio transitions. However, O2 sensors 160 may be any suitable type of sensor that enables control system 104 to function as described herein.

In the example embodiment, the engine controller 164 controls operation of the engine 106, such as controlling airflow/fueling/spark to achieve a desired drive torque. This desired drive torque could be based, for example, on input provided by a driver of the vehicle 100 via an accelerator pedal 176 (FIG. 1). The controller 164 also implements at least a portion of the techniques of the present disclosure, which are described in greater detail below with respect to FIG. 3.

Figure 3:
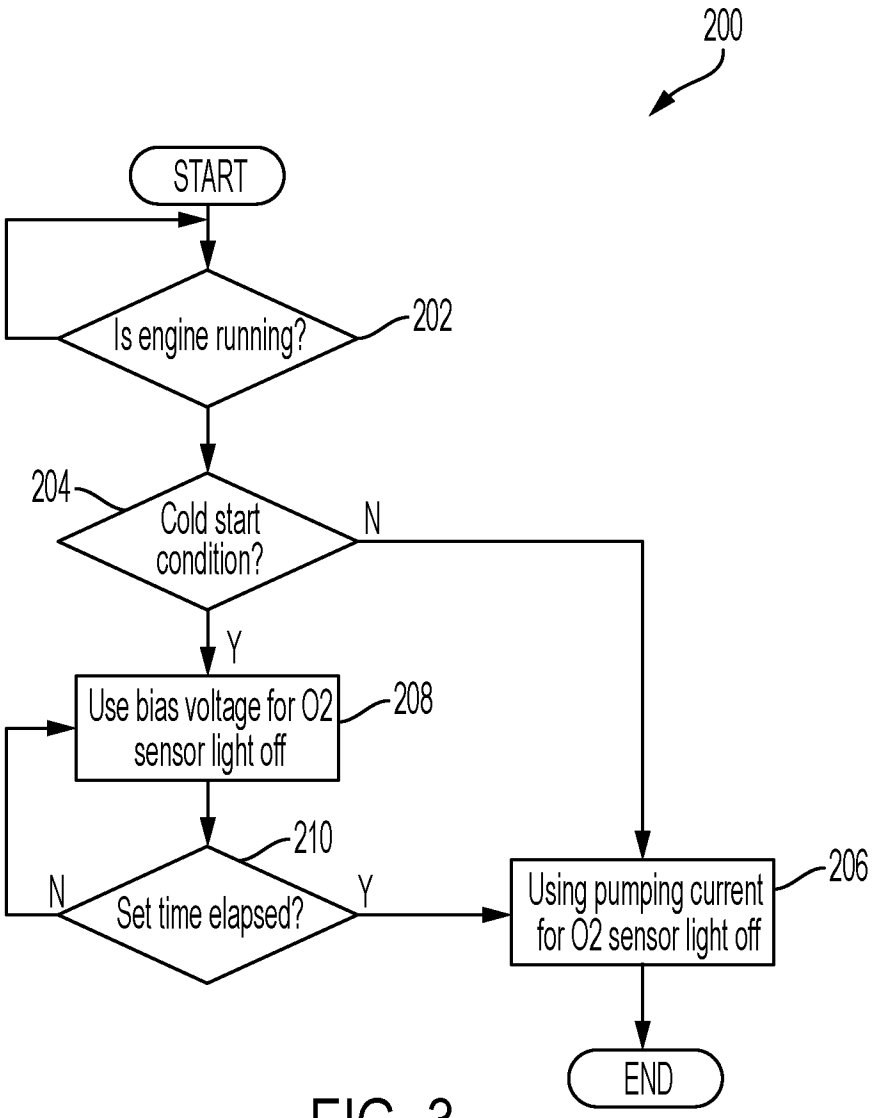
FIG. 3 is a flow diagram of an example method of controlling the vehicle for rapid oxygen sensor light-off to reduce exhaust emissions during a cold start, in accordance with the principles of the present application.

Referring now to FIG. 3, a flow diagram of an example method 200 of controlling vehicle 100 to achieve rapid O2 sensor light-off to reduce exhaust emissions during a cold start is presented. At step 202, engine controller 164 ("control") determines if the engine 104 is running. If no, control returns to step 202. If yes, at step 204, control determines if the engine 104 is under a cold start or emissions test condition. For example, control may monitor one or more temperature sensors (not shown) to determine if an engine coolant temperature is within a predetermined threshold of ambient temperature. If no, control proceeds to step 206 and moves or actuates switch 170 to connect the second bias circuit 174 to the O2 sensor 160. As such, the second bias circuit 174 provides the O2 sensor 160 with the second voltage (e.g., 5 V) for pumping current to light-off the O2 sensor 160 in a normal manner. Control may then end or return to step 202. If a cold start condition does exist, control proceeds to step 208.

At step 208, control actuates switch 170 to connect the first bias circuit 172 to the O2 sensor 160 and provide the first voltage for rapid O2 sensor light-off detection. In the example embodiment, the first bias voltage is 450 mV or approximately 450 mV. At step 210, control determines if a predetermined amount of time has elapsed while providing the first bias voltage to O2 sensor 160. In one example, the predetermined elapsed time is between 10-20 seconds or between approximately 10-20 seconds, for example, to ensure the O2 sensor 160 is heated to the predetermined operating temperature. If the predetermined amount of time has not elapsed, control returns to step 210. If the predetermined amount of time has elapsed, control proceeds to step 206 and actuates switch 170 to connect the second bias circuit 174 to the O2 sensor 160. This provides the pumping current second bias voltage to O2 sensor 160 to enable normal operation in closed loop feedback control to further reduce exhaust emissions. Control may then end or return to step 202.

Described herein are systems and methods for reducing exhaust emissions during a cold start of an internal combustion vehicle. During a cold start or other sufficient condition, the engine controller utilizes an additional biasing circuit to initially provide a 450 mV bias voltage to the oxygen sensor for rapid sensor light-off detection. This in turn enables the system to quickly begin closed loop fueling control with a targeted fuel-air ratio to reduce tailpipe emissions (e.g., HC, NOx). After a predetermined time, the engine controller switches to a primary biasing circuit to provide a typical pumping current bias voltage.

It will be appreciated that the term "controller" or "module" as used herein refers to any suitable control device or set of multiple control devices that is/are configured to perform at least a portion of the techniques of the present disclosure. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. A control system for a vehicle having an internal combustion engine with an exhaust system, the control system comprising:

one or more oxygen (O2) sensors disposed proximate to a catalytic converter in the exhaust system, the one or more O2 sensors each being configured to measure an O2 level of exhaust gas produced by the engine;

a first bias circuit configured to provide a first bias voltage to the one or more O2 sensors; and a second bias circuit configured to provide a second bias voltage to the one or more O2 sensors, the second bias voltage being higher than the first bias voltage; and a controller programmed to:

detect a cold start condition;

upon detecting the cold start condition, connect the one or more O2 sensors to the first bias circuit to receive the first bias voltage to rapidly detect a usable signal indicating light off of the one or more O2 sensors, to thereby facilitate initiation of a closed loop feedback control to reduce exhaust emissions; and subsequently connect the one or more O2 sensors to the second bias circuit to receive the second bias voltage to operate in the closed loop feedback control.

2. The control system of claim 1, wherein the second bias voltage is a pumping current bias voltage.

3. The control system of claim 2, wherein the pumping current is between approximately 10 mA and approximately 20 mA.

4. The control system of claim 1, wherein the second bias voltage is approximately 5 volts.

5. The control system of claim 4, wherein the first bias voltage is approximately 0.45 volts.

6. The control system of claim 1, wherein the controller is programmed to connect the first bias circuit to the one or more O2 sensors for a predetermined period of time before connecting the one or more O2 sensors to the second bias circuit.

7. The control system of claim 6, wherein the predetermined period of time is approximately 20 seconds.

8. The control system of claim 1, wherein the one or more O2 sensors comprise:

a galvanic cell battery; and a pair of porous platinum electrodes separated by layers of zirconia.

9. The control system of claim 8, wherein the one or more O2 sensors generate a voltage between approximately 0.1 volts and approximately 0.9 volts to provide a signal to the controller for the closed loop feedback control.

10. The control system of claim 1, wherein the controller includes a switch configured to selectively connect to either the first bias circuit or the second bias circuit.

11. A method of reducing exhaust emissions during a cold start of a vehicle having an internal combustion engine with an exhaust system, the method comprising:

providing a controller in electrical communication with one or more oxygen (O2) sensors disposed proximate to a catalytic converter in the exhaust system, the one or more O2 sensors each being configured to measure an O2 level of exhaust gas produced by the engine;

providing a first bias circuit configured to provide a first bias voltage to the one or more O2 sensors;

providing a second bias circuit configured to provide a second bias voltage to the one or more O2 sensors, the second bias voltage being higher than the first bias voltage;

detecting, by the controller, a cold start condition;

connecting, by the controller, the one or more O2 sensors to the first bias circuit to receive the first bias voltage to rapidly detect a usable signal indicating light off of the one or more O2 sensors, to thereby facilitate initiation of a closed loop feedback control to reduce exhaust emissions; and subsequently connecting, by the controller, the one or more O2 sensors to the second bias circuit to receive the second bias voltage for normal operation in the closed loop feedback control.

12. The method of claim 11, wherein the second bias voltage is a pumping current bias voltage.

13. The method of claim 12, wherein the pumping current is between approximately 10 mA and approximately 20 mA.

14. The method of claim 11, wherein the second bias voltage is approximately 5 volts.

15. The method of claim 14, wherein the first bias voltage is approximately 0.45 volts.

16. The method of claim 11, wherein the first bias circuit is connected to the one or more O2 sensors for a predetermined period of time before connecting the one or more O2 sensors to the second bias circuit.

17. The method of claim 16, wherein the predetermined period of time is approximately 20 seconds.

18. The method of claim 11, wherein the one or more O2 sensors comprise:

a galvanic cell battery; and a pair of porous platinum electrodes separated by layers of zirconia.

19. The method of claim 18, wherein the one or more O2 sensors generate a voltage between approximately 0.1 volts and approximately 0.9 volts to provide a signal to the controller for the closed loop feedback control.

20. The method of claim 11, wherein the controller includes a switch configured to selectively connect to either the first bias circuit or the second bias circuit.

* * * * *